US006032341A

United States Patent [19]

Cain et al.

[11] Patent Number: 6,032,341

[45] Date of Patent: Mar. 7, 2000

[54] SINGLE IMPINGEMENT BULKING JET

[75] Inventors: Terry Robin Cain, Greenwood; Dennis Leslie Frost, Newark, both of Del.; Melvin Harry Johnson; Maurice Cornelius Todd, both of Chadds Ford, Pa.

[73] Assignee: E. I. du Pont de Nemours and Company, Wilmington, Del.

[21] Appl. No.: 08/956,408

[22] Filed: Oct. 24, 1997

[51] Int. Cl.[7] ..... D02G 1/12; D02G 1/16

[52] U.S. Cl. ..... 28/274; 28/221; 28/263; 28/271

[58] Field of Search ..... 28/220, 221, 247, 28/258, 262, 263, 264, 269, 271, 274, 281; 57/208, 908

[56] References Cited

U.S. PATENT DOCUMENTS

| | | | |
|---|---|---|---|
| Re. 28,482 | 7/1975 | Buzano | 57/140 J |
| 2,995,801 | 8/1961 | Cormier et al. | 28/1 |
| 3,169,296 | 2/1965 | Clendening | 28/1 |
| 3,251,181 | 5/1966 | Breen et al. | 57/140 |
| 3,525,134 | 8/1970 | Coon | 28/1.4 |
| 3,678,549 | 7/1972 | Buzano | 28/72.12 |
| 3,712,526 | 1/1973 | Hanousek et al. | 226/97 |
| 3,802,036 | 4/1974 | Parks | 28/1.4 |
| 3,816,887 | 6/1974 | Smith et al. | 28/1.4 |
| 3,823,448 | 7/1974 | Roberts | 28/274 |
| 4,949,441 | 8/1990 | Ethridge | 28/274 |
| 5,025,538 | 6/1991 | Saleh | 28/263 |
| 5,140,729 | 8/1992 | Simmen | 28/274 |
| 5,325,572 | 7/1994 | Dickson, III et al. | 28/276 |
| 5,497,538 | 3/1996 | Graf et al. | 28/264 |

FOREIGN PATENT DOCUMENTS

| | | | |
|---|---|---|---|
| 2 310 431 | 12/1976 | France | D02J 1/08 |
| 28 56 290 | 7/1980 | Germany | D02J 1/16 |
| 36 09 216 C1 | 8/1987 | Germany | D02J 1/16 |
| 2 005 737 | 4/1979 | United Kingdom | D02J 1/02 |

*Primary Examiner*—Amy Vanatta

[57] ABSTRACT

The present invention is directed to: a non-interlacing expirating yarn bulker comprising a body having an enclosed yarn passage extending therethrough. The yarn passage includes an inlet region, a throat region and an expanding region. A single pressurized fluid channel extends through the body and intersects with the yarn passage in the throat region. Cross sectional areas at certain defined locations in the yarn passage exhibit predetermined relationships. In addition, the inlet region and the pressurized fluid channel both are symmetrical about a common reference plane of symmetry;

a replaceable wear member insertable into a body of a jet having a yarn passage with an inlet region and a throat region. The wear member has an upstream face, a downstream face, and a channel extending therebetween. The intersection of the channel and the downstream face of the member defines a wear edge. When inserted into the body the channel defines at least a portion of the inlet region of the yarn passage;

a yarn bulker that includes a stuffer chamber section communicating with the yarn passage for forming a wad of yarn, and, a yarn transport section. The yarn transport section is formed by a tubular member having a first and a second end and having an axial bore extending therethrough. The first end of the tubular member communicates with the stuffer chamber. In accordance with the invention the tubular member has a passage communicating with the axial bore formed adjacent to the second end thereof. A deflector plate is attached to the tubular member adjacent to the second end thereof, the deflector being inclined and perforated with slots which define tines.

12 Claims, 12 Drawing Sheets

SINGLE IMPINGEMENT BULKING JET

BACKGROUND OF THE INVENTION

1. Field of the Invention

The present invention relates to various improvements in yarn jet technology.

2. Description of the Prior Art

Jets for treating yarn with high velocity, high temperature fluids for the purpose of bulking the yarn are known.

Bulking yarn are described in U.S. Pat. No. 3,802,036 (Parks), U.S. Pat. No. 2,995,801 (Cormier et al.), U.S. Pat. No. 3,251,181 (Breen et al.), U.S. Pat. No. 3,169,296 (Clendening ), and U.S. Pat. No. 3,525,134 (Coon). These jets are configured either to include passages oriented to provide opposed fluid impingement on the yarn or to provide swirling fluid flows. However, these configurations, in addition to bulking yarn, also cause interlacing of the filaments of the yarn to occur.

It is not always desired to simultaneously bulk and interlace the product. In some cases, after a yarn is bulked, it is desired to insert an additional filament in the yarn strand, such as an anti-static filament. In such an instance bulk must be imparted to the yarn without the creation of interlacing among the yarn filaments. In addition, it may be desirable to separate the bulking and interlacing functions in order to optimize the performance of each function.

In view of the foregoing it is believed advantageous to provide a jet construction that isolates the bulking from the interlace function, hereby imparting flexibility to the yarn processing and the ability to optimize separately each of the bulking and interlacing function.

SUMMARY OF THE INVENTION

In a first aspect the present invention is directed to a non-interlacing expirating yarn bulker comprising a body having an enclosed yarn passage extending therethrough. The yarn passage includes, in the direction of yarn flow, an inlet region, a throat region and an expanding region. A single pressurized fluid channel extends through the body and intersects with the yarn passage in the throat region.

Structurally, the throat region, at its downstream end, has a substantially rectangular cross-sectional configuration taken in a first cross-sectional plane perpendicular to a first yarn flow vector defined at the downstream end of the throat region. This area of the throat region at its downstream end is indicated by $A_t$. The area $A_i$ of the inlet region where it joins the throat region is less than the area $A_t$.

The pressurized fluid channel in the vicinity of its intersection with the throat region has a rectangular cross-sectional configuration taken in a second cross-sectional plane perpendicular to a fluid flow vector extending therethrough. This area of the pressurized fluid flow channel in the vicinity of its intersection with the throat region is denoted by $A_p$.

The expanding region has an exit end spaced a predetermined distance L from the throat, the distance L being in the range from about one (1) inch to about twelve (12) inches. The end of the expanding region has a rectangular cross-sectional area taken in a third cross-sectional plane perpendicular to a second yarn flow vector defined at the downstream end of the expanding region. This area of the expanding region at its end is indicated by $A_e$.

In accordance with the present invention, the following areal relationships hold:

the ratio of the area $A_t$ to the area $A_p$ is in the range from about 0.5 to about 2.0; and the ratio of the area $A_e$ to the area $A_t$ to being in the range from about 1.1 to about 3.0.

In addition, the inlet region and the pressurized fluid channel both are symmetrical about a common reference plane of symmetry. The throat and the pressurized fluid channel, along their intersection, have equal width dimensions, as taken in any cross-sectional plane perpendicular to an axis aligned with the first yarn flow vector and extending through the throat.

In accordance with a second aspect the present invention is directed to a wear member insertable into a body of a jet having a yarn passage with an inlet region and a throat region. The wear member has an upstream face, a downstream face, and a channel extending therebetween. The intersection of the channel and the downstream face of the member defines a wear edge. When inserted into the body the channel defines at least a portion of the inlet region of the yarn passage. The downstream face of the member defines the upstream boundary of the throat.

In yet another aspect, the present invention is directed to a yarn bulker that includes a stuffer chamber section communicating with the yarn passage for forming a wad of yarn, and, a yarn transport section. The yarn transport section is formed by a tubular member having a first and a second end and having an axial bore extending therethrough. The first end of the tubular member communicates with the stuffer chamber. In accordance with the invention the tubular member has a passage communicating with the axial bore formed adjacent to the second end thereof. A deflector plate is attached to the tubular member adjacent to the second end thereof. The deflector plate is inclined to the axis of the bore and toward the passage in the tubular wall member, the angle of inclination being in the range from about thirty (30) to about sixty (60) degrees. The deflector plate has perforations therein, where the perforations take form of a plurality of slots that define a plurality of tines. Each tine has an end thereon, the ends of the tines being within the passage and defining a portion of the boundary thereof.

BRIEF DESCRIPTION OF THE FIGURES

The invention will be more fully understood from the following detailed description, taken in connection with the accompanying drawings, which form a part of this application and in which:

FIG. 7A is a sectional view of the stuffer chamber portion of the stuffer tube taken along section lines 7A—7A in FIG. 2A, while

FIG. 8A is an elevational view, eniterely in section, of the of the lower end of the stuffer tube shown in FIG. 2A, while

FIGS. 9A through 9C are side elevational views of the jet portion of the yarn bulker taken along view lines 9A—9A in FIG. 1 illustrating the relative positions between the base and the cover as these members are moved with respect to each other from the open to the closed position; while

DETAILED DESCRIPTION OF THE INVENTION

Figure 1:
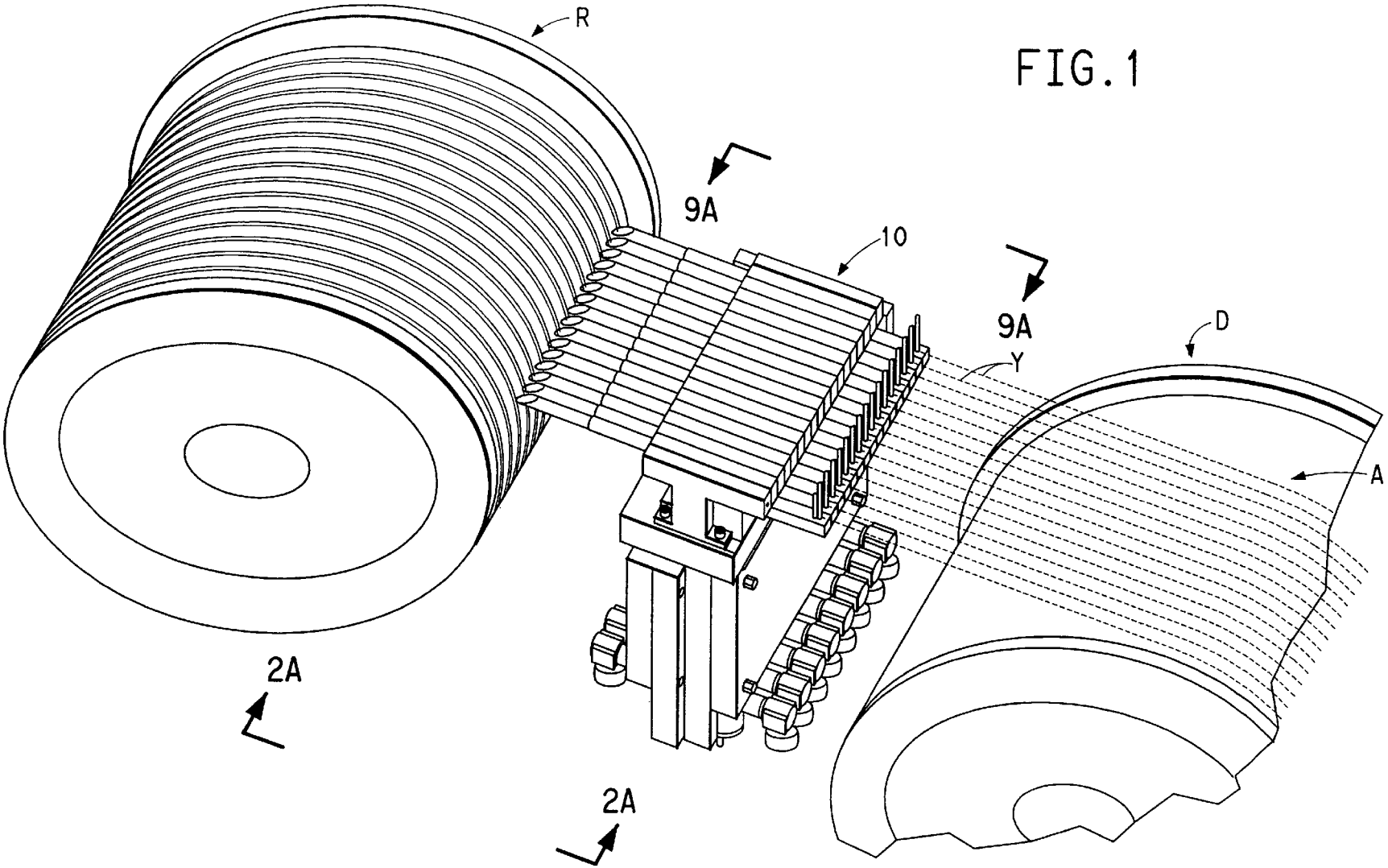
FIG. 1 is a perspective view of a bank of yarn bulkers, each in accordance with the present invention, and a portion of an associated roll, useful for processing a warp array of yarns.

Throughout the following detailed description, similar reference numerals refer to similar elements in all Figures of the drawings.

With reference to FIG. 1 shown is a perspective view of a portion of an apparatus for processing a warp array A of individual yarns Y that includes a bank of yarn bulkers 10, each in accordance with the present invention. The bank of yarn bulkers 10 is disposed in the processing path of the warp A of continuous filament yarns Y between a heated draw roll D and a porous grooved roll R. The yarn bulker herein described is believed most useful with such continuous multifilament yarns. Each yarn bulker 10 is configured to bulk the yarn Y without causing interlacing among the filaments comprising the yarn. Imparting bulk independently of interlacing is believed desirable since, by separating these functions, both bulking and interlacing may be optimized. The bulking process employs hot fluid, such as steam or hot air. The yarn leaves each bulker 10 as a compact wad of filaments that is deposited on a grooved roll R, where it is cooled before removal.

Figure 2A:
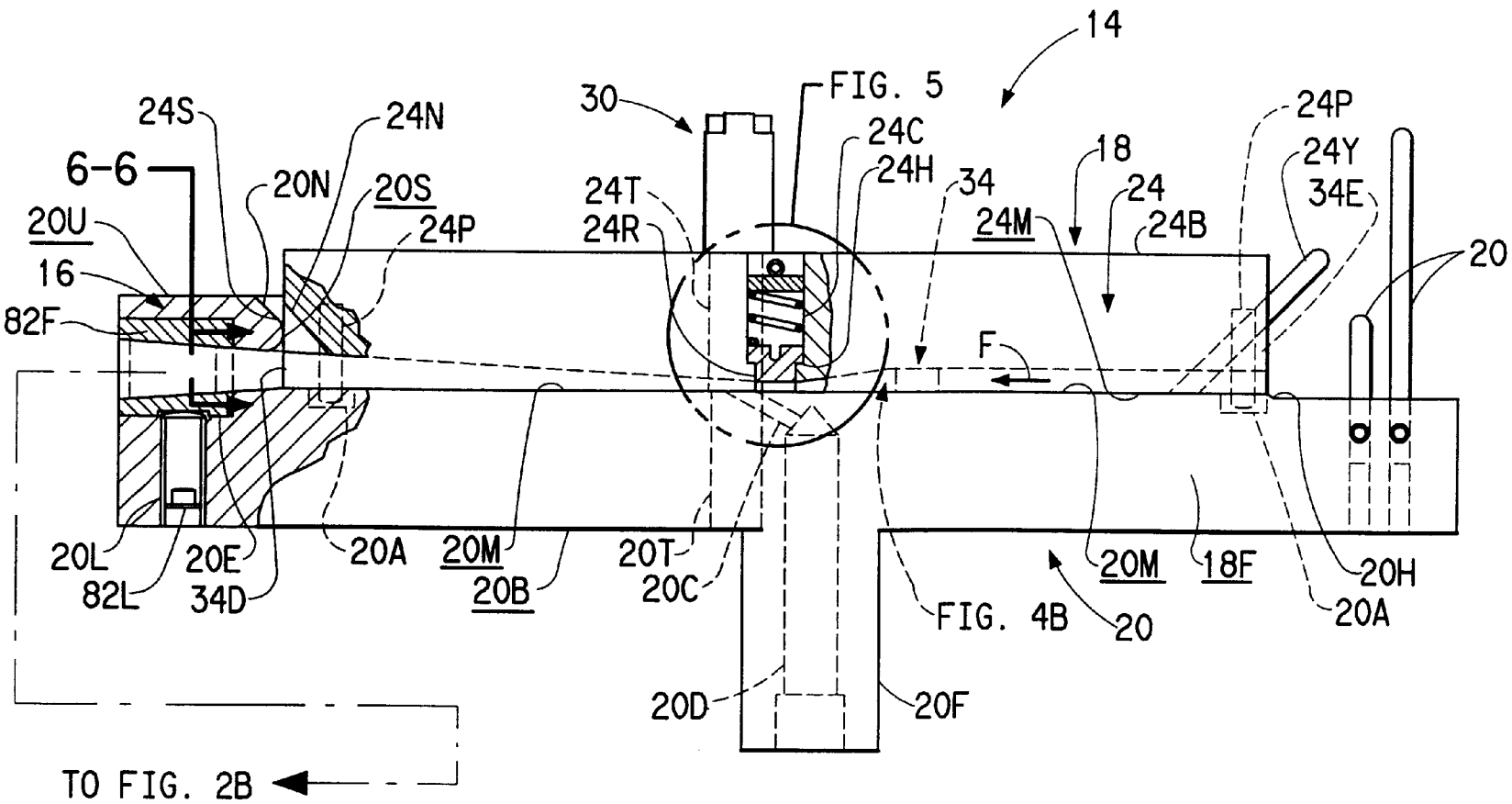
FIGS. 2A and 2B are side elevational views, partially in section, taken along view lines 2—2 in FIG. 1, illustrating a yarn bulker in accordance with the present invention.
Figure 2B:
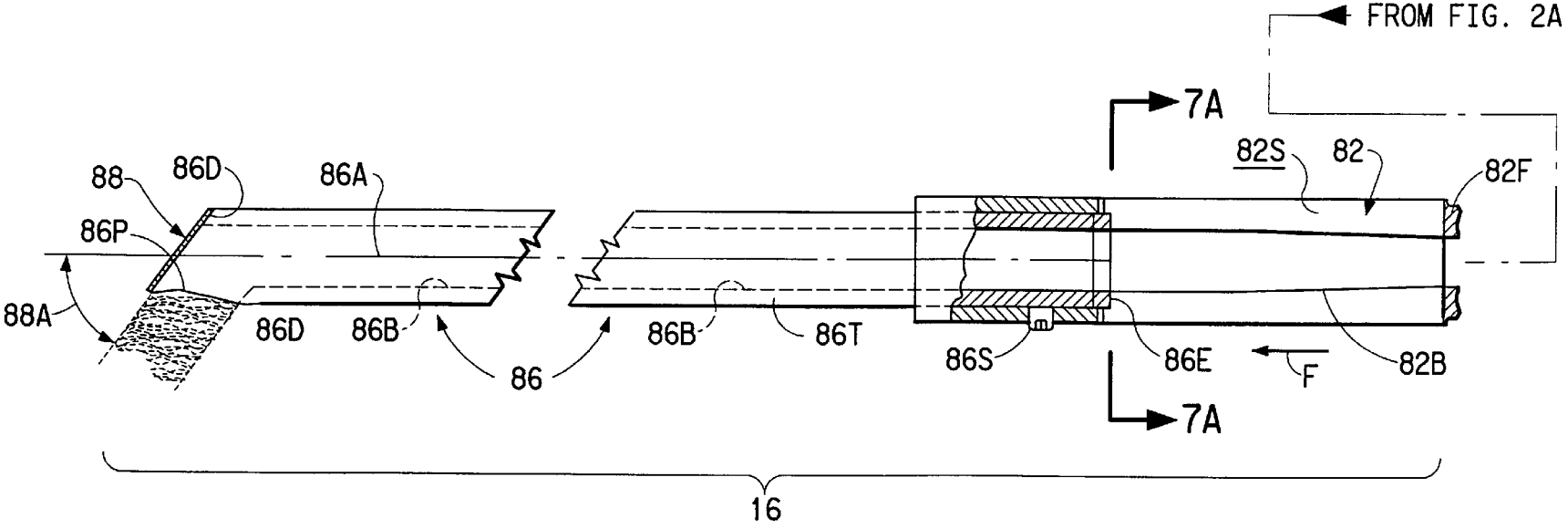

One of the yarn bulkers 10 included within the bank is illustrated in side elevational, partial section views of FIGS. 2A and 2B. FIG. 2A shows the jet portion 14 while FIG. 2B shows the stuffer tube portion 16 of the yarn bulker 10.

The jet portion 14 comprises a body generally indicated by the character 18 formed of two separable and conjoinable body structural members, namely, a base 20 and a cover 24. The body has a front surface 18F (visible in FIG. 2A) and a rear surface 18R (visible in FIGS. 9A through 9C). The base 20 and the cover 24 are connected to each other by a pair of links 26 disposed on the rear surface 18R of the body 18 (illustrated FIGS. 9A through 9D) and secured in the joined state by a locking bolt 30. The locking bolt 30 is shown only in elevation in FIG. 2A, but is discussed in connection with FIGS. 9A through 9D. Although the body 18 is preferably formed in two pieces for ease of machining and to facilitate threading of the bulker, it should be understood that the body 18 may be integrally formed from a solid member and remain within the contemplation of the present invention.

The base 20 is a block member, preferably fabricated from stainless steel, having both a planar sealing surface 20S and a distinct precision planar mating surface 20M machined thereon. The plane of the sealing surface 20S intersects with the plane of the mating surface 20M, preferably at an intersection angle of approximately ninety (90) degrees. The planar mating surface 20M extends across the base 20 from the line of intersection with the sealing surface 20S to a shoulder 20H. An aligning slot 20A is provided at the upper and lower margin of the planar mounting surface 20M. A mounting opening 20T, for the locking bolt 30, extends through the base 20 from a location approximately midway along the mating surface 20M to the back surface 20B.

The upper end of the base 20 has a pair of yarn guide pins 20G projecting forwardly thereform. The pins 20G serve to guide yarn into the bulker 10 during threading of the bulker 10. The lower end of the base 20 has a central recess 20E for accepting the stuffer tube 16 (FIG. 2A). A locking set screw passage 20L that opens from the back surface 20B intersects with the central recess 20E. The edge of the sealing surface 20S and the surface 20U are interrupted by a shallow yarn threading notch 20N useful during threading of the bulker 10.

Figure 3:
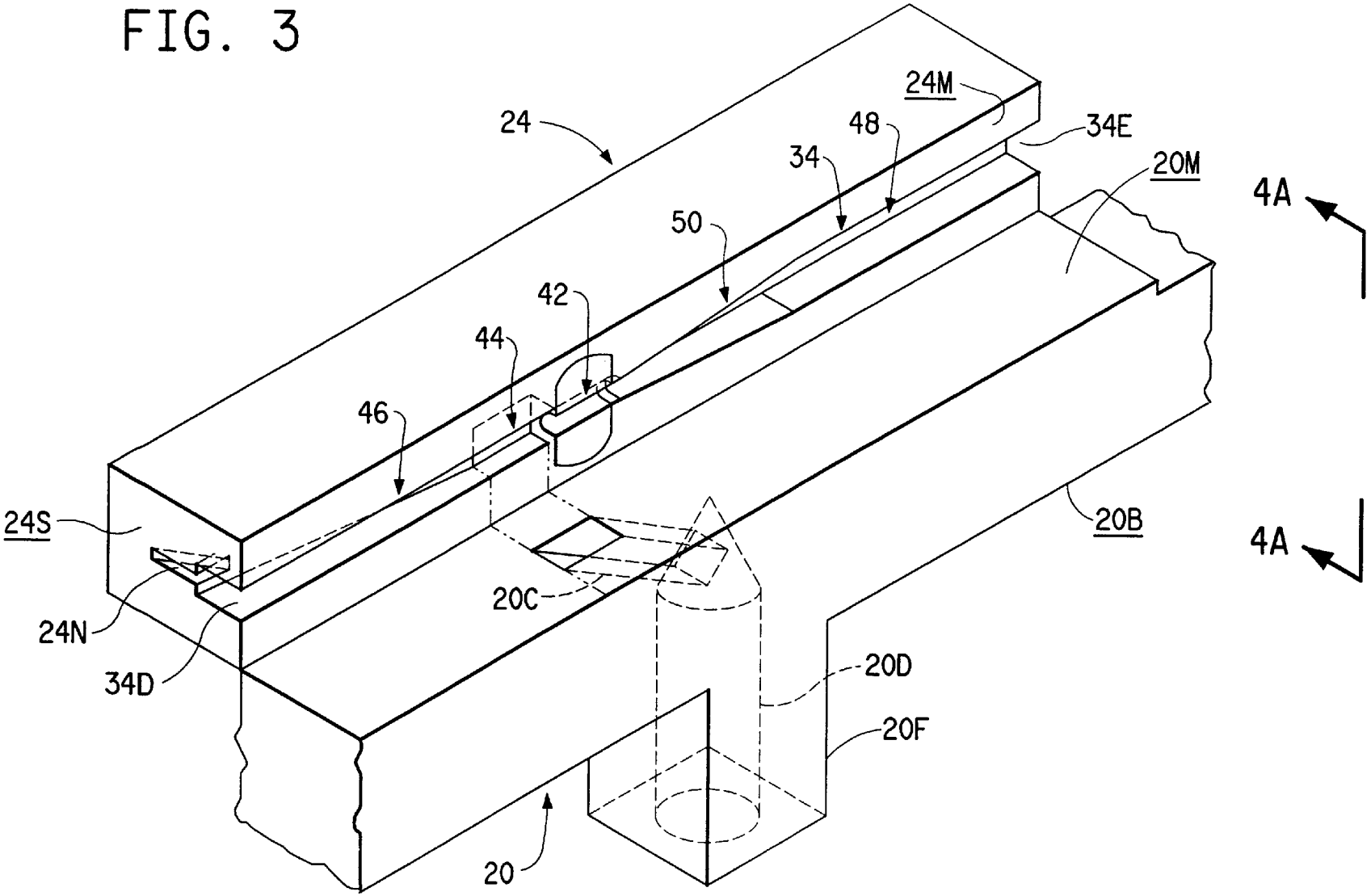
FIG. 3 is a perspective view of the upper portion of the yarn bulker shown in FIG. 2 folded open to illustrate the various passages extending through the yarn bulker.

The planar mating surface 20M is interrupted by the mouth of a single pressurized fluid channel 20C (FIG. 3). The channel 20C is completely formed within the base 20 and inclines therethrough at a predetermined angle 20J (FIG. 5) to the surface 20M. The opposite end of the pressurized fluid channel 20C communicates with a conduit 20D (FIG. 3) extending through a flange 20F projecting rearwardly from the back surface 20B of the base 20. The conduit 20D terminates in an opening that is connectible to a source of hot pressurized fluid, such as hot air or steam, for heating and bulking the yarn passing through the yarn bulker 10.

The cover 24 is also a block member, also preferably fabricated from stainless steel, having a precision planar mating surface 24M and a distinct planar sealing surface 24S machined thereon. The sealing surface 24S is interrupted by an shallow threading notch 24N that registers with the notch 20N (FIG. 2A) formed in the base to define a threading passage.

The plane of the sealing surface 24S intersects with the plane of the mating surface 24M, again at an angle of approximately ninety (90) degrees. A pair of aligning pins 24P (FIG. 2A) extend from the upper and lower margins of the planar mounting surface 24M on the cover 24. The aligning pins 24P are mutually spaced so as to register with the aligning slots 20A in the base. A wear insert counterbore 24C extends through the cover 24 from the back surface 24B to the mating surface 24M thereof. The wear insert counterbore 24C has an abutment shoulder 24H formed therein. The portion of the counterbore 24C above the shoulder 24H is cylindrical, while the portion 24R below the shoulder 24H is generally rectangular, to prevent rotation of an insert that is received within that counterbore 24C.

A mounting opening 24T, also for the locking bolt 30, extends through the cover 24 at a location in registry with the corresponding mounting opening 20T in the base. A yarn guide assist 24Y, also used in threading of the bulker 10, extends from the end of the cover 24.

The planar mating surface 24M of the cover 24 has an elongated, contoured groove 34 (best seen in FIGS. 3 and 4B) that extends from an entrance end 34E to an exit end 34D. When the cover 24 and base 20 are joined along their respective mating surfaces 24M, 20M, the groove 34 in the cover 24 and the mating surface 24M on the base 20 cooperate to define an enclosed, yarn bulking passage generally indicated by the reference character 40 (FIG. 4B). The yarn passage 40 extends axially through the conjoined members 20, 24 and has predetermined contoured regions formed therealong. Yarn is conveyed through the passage along an axial yarn path indicated by the reference arrow F. Since in the embodiment illustrated in the Figures the planar mating surface 20M on the base 20 serves only to close the groove 34, thereby to define the yarn passage 40, it should be apparent that it is the contours of the various portions of the groove 34 that impart the contours to the various predetermined regions of the yarn passage 40. However, in the following description, the contours of the various regions are described as attributes of the yarn passage 40, without corresponding direct reference to the groove 34.

The yarn bulking passage 40 includes an inlet region 42 (FIGS. 4A and 4B), a throat region 44 and an expanding region 46. The inlet region 42 joins the throat region 44 at the upstream end 44E (defined in terms of the direction of yarn flow F) of the throat 44, while the expanding region 46 joins the throat region 44 at the downstream end 44D of the throat 44 (also defined in terms of the direction of yarn flow F). The throat region 44 is formed axially along the groove 34 such that when the cover 20 and the base 24 are joined the mouth of the pressurized fluid channel 20C lies within the throat region 44, with downstream boundary of the mouth of the channel 20C coinciding with the downstream end 44D of the throat 44. Thus, the single pressurized fluid channel 20C extending through the body 18 intersects with the yarn bulking passage 40 in the throat region 44 thereof.

Upstream (in the direction of the yarn flow F) of the inlet region 42 are defined an enlarged entrance region 48 and a converging region 50. The regions 48 and 50 loosely guide an individual yarn Y to the inlet region 42. The regions 48 and 50 also serve to vent any fluid flow from the throat region 44 toward the inlet end 34E of the groove 34 in a direction E opposite the direction of yarn flow F. This fluid may advantageously serve to preheat the yarn Y. The regions 48 and 50 have a generally rectangular cross-section perpendicular to the direction of yarn flow F) to minimize fluid flow turbulence that may entangle yarn Y as it passes through these regions.

Figure 4A:
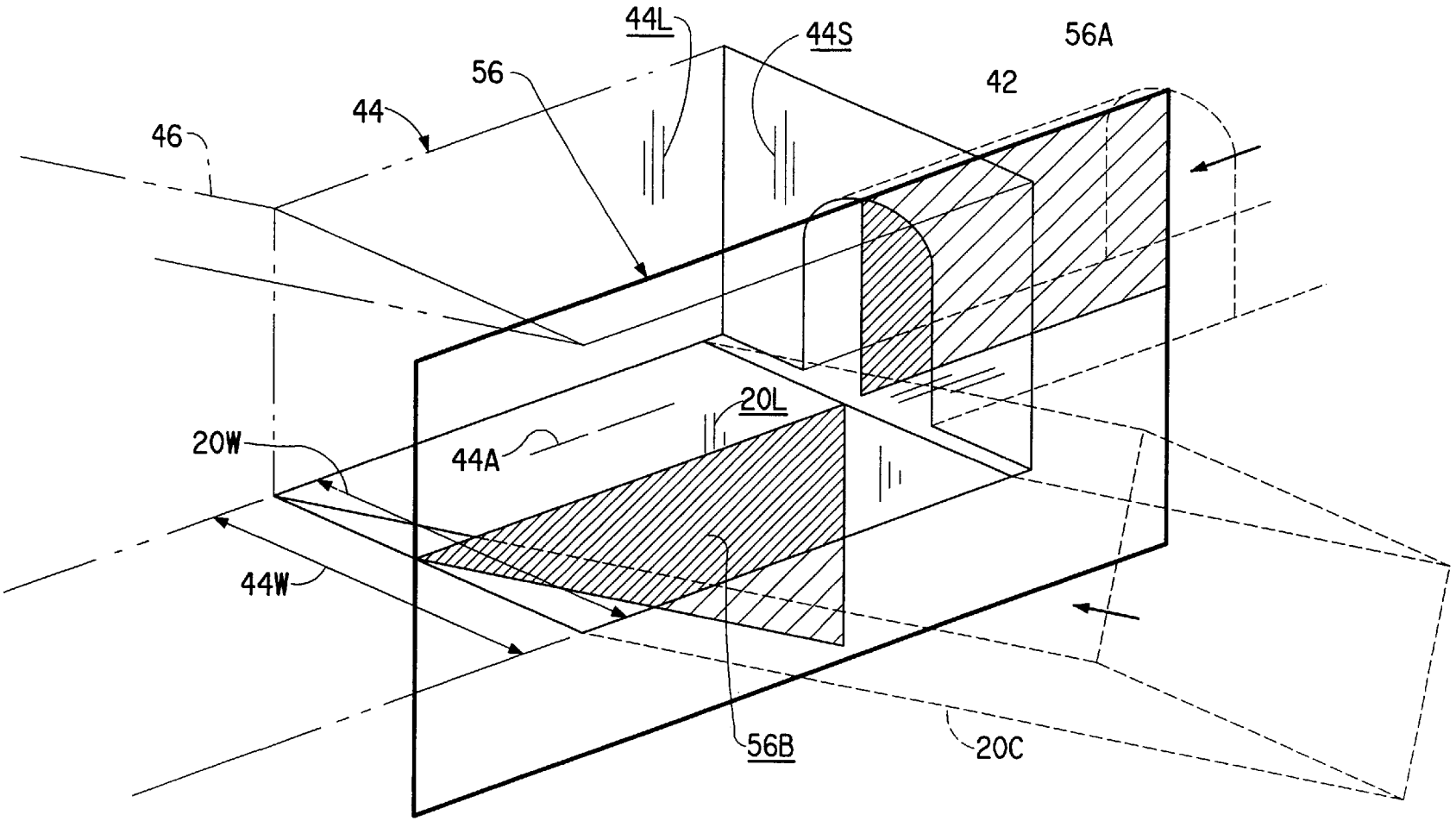
FIGS. 4A and 4B are, respectively, a stylized perspective view and a side section view taken along section lines 4A—4A in FIG. 3, both illustrating the various structural relationships regions of the yarn passage defined through the yarn bulker in accordance with the present invention.
Figure 4B:
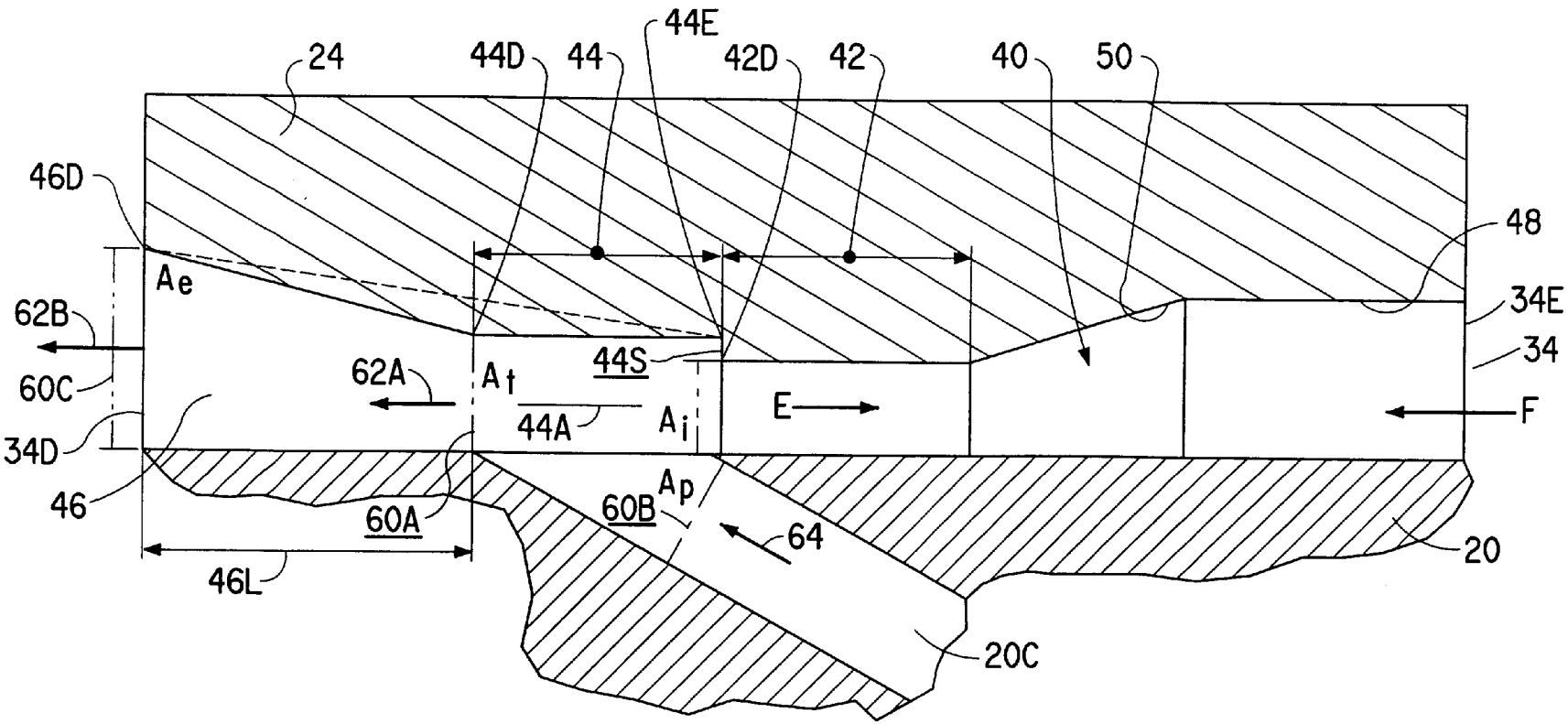

From FIGS. 3, 4A and 4B the various structural relationships among regions of the yarn bulking passage 40 defined through jet portion 14 of the bulker 10 in accordance with the present invention may be understood.

As is best seen in FIG. 4A, fluid flow in the inlet region 42 and the pressurized fluid channel 20C meet in the throat 44. As can be seen in the Figure, the geometric shapes and sizes of the inlet region 42 and the pressurized fluid channel 20C are different which tends to introduce fluid flow turbulence in the throat 44 that may entangle the yarn Y passing therethrough. It is believed that the effect of the different geometries can be minimized if the inlet region 42 and the pressurized fluid channel 20C are both symmetrical about a common reference plane of symmetry generally indicated by the reference character 56.

In the FIG. 4A the common reference plane of symmetry 56 is illustrated in bold outline. For clarity of understanding the rectangular hatched region in FIG. 4A denotes the plane of symmetry 56A through the inlet region 42 of the yarn passage. The triangular hatched region in FIG. 4A denotes the plane of symmetry 56B through the pressurized fluid channel 20C. The planes 56A, 56B both lie within the common reference plane of symmetry 56. By having this defined symmetrical relationship it is believed that pressurized fluid turbulence which would otherwise lead to filament interlacing is minimized or eliminated.

As seen from FIGS. 3 and 4B, the throat region 44, at its downstream end 44D (as defined in terms of the direction of yarn flow F), has a substantially rectangular cross-sectional configuration taken in a first cross-sectional plane 60A perpendicular to a first yarn flow vector 62A defined at the downstream end 44D of the throat region 44. The area of the throat region 44 at its downstream end 44D is referred to herein as $A_t$.

The area of the yarn passage 40 at the downstream end 42D (in the direction of yarn flow F) of the inlet region 42 is less than the area $A_t$ of the throat 44 at its downstream end 44D. This area of the yarn passage at the downstream end 42D of the inlet region 42 is referred to herein as area $A_i$. The disparity between the area $A_t$ and the area $A_i$ manifests itself in the drawings by a shoulder 44S defined at the interface between the inlet region 42 and the throat region 44.

The pressurized fluid channel 20C in the vicinity of its intersection with the throat region 44 has a rectangular cross-sectional configuration taken in a second cross-sectional plane 60B that is perpendicular to a fluid flow vector 64 extending therethrough. The area of the pressurized fluid flow channel 20C in the vicinity of its intersection with the throat region 44 is referred to herein as $A_p$.

The expanding region 46 has a downstream end 46D spaced a predetermined distance 46L from the downstream end 44D of the throat 44, the distance 46L being in the range from about one (1) inch to about twelve (12) inches. The downstream end 46D of the expanding region 46 has a rectangular cross-sectional area taken in a third cross-sectional plane 60C perpendicular to a second yarn flow vector 62B defined at the downstream end 46D of the expanding region 46. The area of the expanding region 46 at its downstream end 46D is referred to as $A_e$.

The flow of fluid from the throat is important to the bulking operation of the jet portion 14. To effectively engage the yarn Y and forcefully tension it to pull it from the roll D and into the jet portion, and to propel the yarn Y into the stuffer tube portion 16, the flow of fluid from the throat and through the expanding region 46 should be supersonic. Supersonic fluid flow is introduced to the throat from the pressurized fluid channel 20C and can be maintained by providing an expanding area ratio from the downstream end 44D of the throat to the downstream end 46D of the expanding region. This is possible with the proviso that the distance 46L is in the range of from about one (1) inch to about twelve (12) inches, based on the scale of yarns jets, to minimize pressure drop in the expanding region that may otherwise eliminate supersonic flow. In accordance with the present invention, and with the above proviso, the ratio of the area $A_e$ to the area $A_t$, hereafter referred to as the supersonic flow ratio, is in the range from about 1.1 to about 3.0.

The flow of fluid from the throat is also important to provide an expirating flow, illustrated by arrow E in FIG. 4B, out of the entrance end 34E of passage 40. Expirating flow prevents the jet portion from drawing in ambient air at entrance end 34E during operation that would act to quench the yarn temperature in the jet portion. It also acts to preheat the counter-flowing yarn as it passes from the entrance end 34E through the inlet region 42. The driving force for the expirating flow is a slight back pressure in the throat region which forces flow through the inlet region 48. This expirating flow, however, must be controlled to a reasonable level to avoid excessive flow that would diminish yarn tension and would diminish the pressure available in the throat region to maintain supersonic flow in the expanding region. In accordance with the present invention, the ratio of the area $A_t$ to the area $A_p$, hereafter referred to as the expirating flow ratio, is in the range from about 0.5 to about 2.0.

Excessive expirating flow is limited since the area $A_i$ is less than the area $A_t$.

Further, in accordance with the present invention it is important that the throat region 44, the expanding region 46, and the pressurized fluid channel 20C have generally rectangular cross-sections. This provides more uniform fluid flow in these regions to minimized flow turbulence that would result in yarn filament entanglement. This is in contrast with many prior art jets that have generally round cross-sectional jet passages where the flow varies greatly across the diameter, since a small unit width of cross-sectional area is constantly changing going from one side of the passage to the other. There is no such variation across a rectangular passage. To avoid any flow disturbances (that would create flow turbulence and a resultant yarn entanglement) as the high pressure fluid from the rectangular pressurized fluid channel enters the rectangular throat, in accordance with the present invention, the throat 44 and the pressurized fluid channel 20C, along their intersection, have equal width dimensions 20W, 44W, respectively (FIG. 4A) that are aligned with one another. The width dimensions under discussion are taken in any cross-sectional plane perpendicular to a reference axis 44A (FIGS. 4A, 4B) extending through the throat 44. The axis 44A is aligned with the first yarn flow vector 62A defined at the downstream end 44D of the throat 44. In addition, the sidewalls 44L of the throat 44 and the sidewalls 20L of pressurized fluid channel 20C are co-planar.

Figure 5:
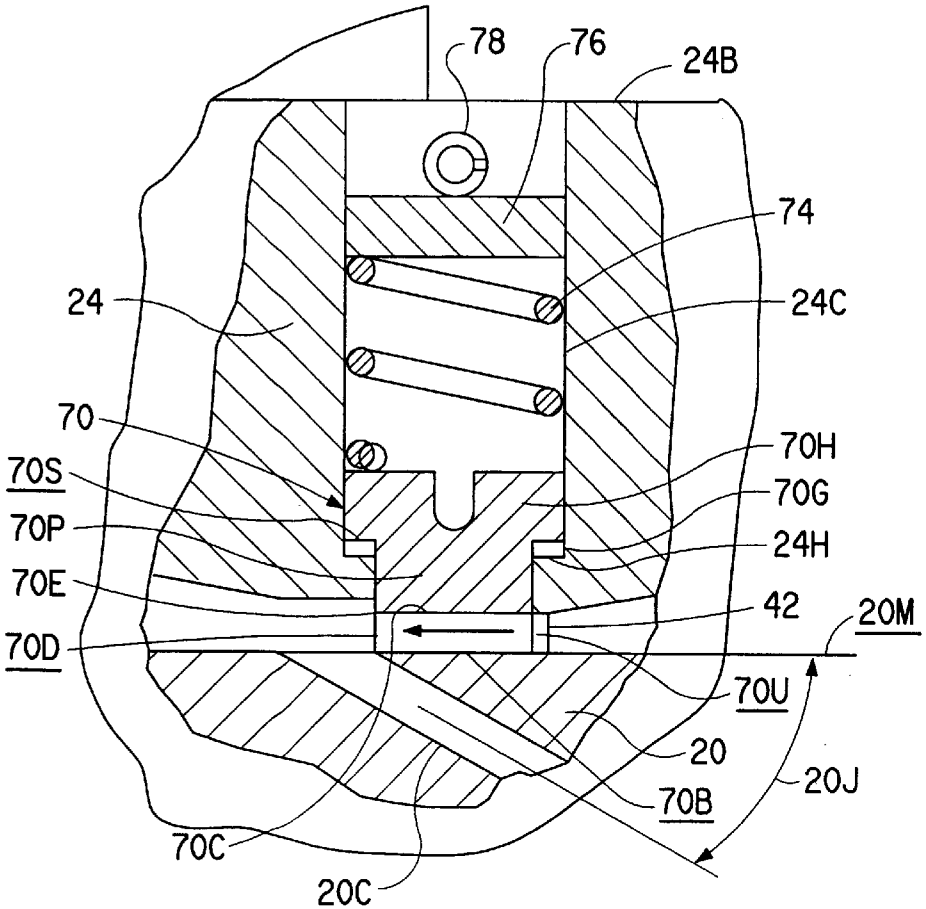
FIG. 5 is an enlarged, side sectional view of the circled portion of FIG. 2B illustrating a removable insert useful in various yarn bulkers, including the yarn bulker of the present invention.

In another aspect the present invention is directed to a wear insert for the fluid jets. The wear insert, which is shown in side elevation in FIG. 5, is useful in a non-interlacing expirating bulking jet as shown in FIGS. 1 through 5, as well as in any jet where a shoulder is present at which a smaller inlet joins a larger throat, thereby creating an abrupt edge or corner. Such a corner is susceptible to rapid wear by a yarn rubbing thereon as the yarn travels past the shoulder.

Wear Member

As the yarn passes through the yarn bulking passage 40 (FIGS. 4A and 4B) it sometimes rubs the walls of the groove in the vicinity of the shoulder 44S defined at the interface between the inlet region 42 and the throat region 44. The yarn often has abrasive substances in the polymer from which the yarn is made that cause accelerated wear on surfaces over which the yarn comes into contact. This wear is exacerbated in the region of the shoulder 44S.

To overcome this problem the present invention uses a wear member 70 that is replaceably insertable into the body 18. The wear member 70 is fabricated of a material having a hardness value greater than the hardness value of the material used to form the body 18 into which the member 70 is inserted. In the present instance the base 20 and the cover 24 are both preferably formed from stainless steel (hardness value of $R_c$40–45, typical of stainless steel 17-4 PH). Accordingly, the wear member 70 should be fabricated from a material, such as tungsten carbide or ceramic, which have a hardness value in excess of that for stainless steel.

In the embodiment of the invention shown in FIG. 5, the wear member 70 includes a relatively enlarged cylindrical head portion 70H that has a generally rectangular plug portion 70P projecting therefrom. The interface between the head portion 70H and the plug portion 70P defining an abutment shoulder surface 70S. The plug portion 70P has an upstream face 70U, a downstream face 70D, and a channel 70C extending therebetween. The intersection of the channel 70C and the downstream face 70D defines a wear edge 70E.

The wear member 70 is insertable into the counterbore 24C in the cover 24 so that, when so inserted into the cover 24, the channel 70C defines at least a portion of the inlet region 42 of the yarn passage 40, while the downstream face 70D of the wear member 70 defines the upstream boundary of the throat 44. The wear member is reversible in the sense that it may be inserted such that either face of the plug may serve as the upstream or downstream face.

The wear member 70 is maintained in the above-described assembled relationship with the cover 24 by a resilient biasing spring 74. The spring 74 biases the undersurface 70B on the wear member 70 into abutting relationship with the mating surface 20M of the base 20. The spring 74 is held in place in the bore 24C by a washer 76 and pin 78. The abutment surface 70S on the wear insert 70 is normally spaced by a gap 70G from the abutment surface defined by the shoulder 24H of the counterbore 24C when the cover is conjoined to the base. The spring 74 forces the undersurface 70B of the plug 70P tightly against the mating surface 20M of the base 20. The gap 70G is sized to be sufficient to compensate for machine tolerances and the difference in thermal growth between the wear insert 70 and the cover 24. When these members are separated the surface 70S on the wear insert 70 bottoms against the shoulder 24H of the counterbore 24C to prevent the insert from being ejected from the counterbore 24C by the spring 74.

The use of the wear member 70 as above described emphasizes the advantage gained by the two-piece embodiment of the yarn bulker of the present invention in which the contoured groove that defines the contours of the yarn passage is contained within one of the members (e. g., the cover 24) forming the body 18 of the bulker, while the fluid channel 20C for the pressurized fluid flow is formed entirely in the other member (the base 20). This separation permits repair to the yarn passage 40 either by replacement of the cover 24 as an entirety, or by the use of the wear member 70 as described. In addition, disposing the fluid channel 20C entirely in the base 20 has the advantage of maintaining constant pressurized primary flow regardless of the seal between the cover 24 and the base 20. This enhances the ability to produce uniform product.

Stuffer Tube

The stuffer tube portion 16 (FIG. 2B) is attached to the lower end of the jet portion 14 in fluid communication with the yarn passage 40. The stuffer tube 16 is a hollow, generally elongated member formed of a stuffer chamber section 82 and a yarn transport section 86. Although the stuffer chamber section 82 and the transport section 86 are shown as being implemented in two parts for ease in fabrication, they may be equivalently combined into one or more structure(s), if desired.

The stuffer chamber section 82 is a generally cylindrical member having a central bore 82B therethrough. The upper end of the stuffer chamber section 82 is reduced in diameter to define a hollow fitting 82F (FIG. 2A) that is received within the central recess 20E at the lower end of the base 24 of the body 18. The stuffer tube portion 16 is held to the body 18 by a locking fastener 82L that is threaded into the passage 20L in the base 20.

Figure 6:
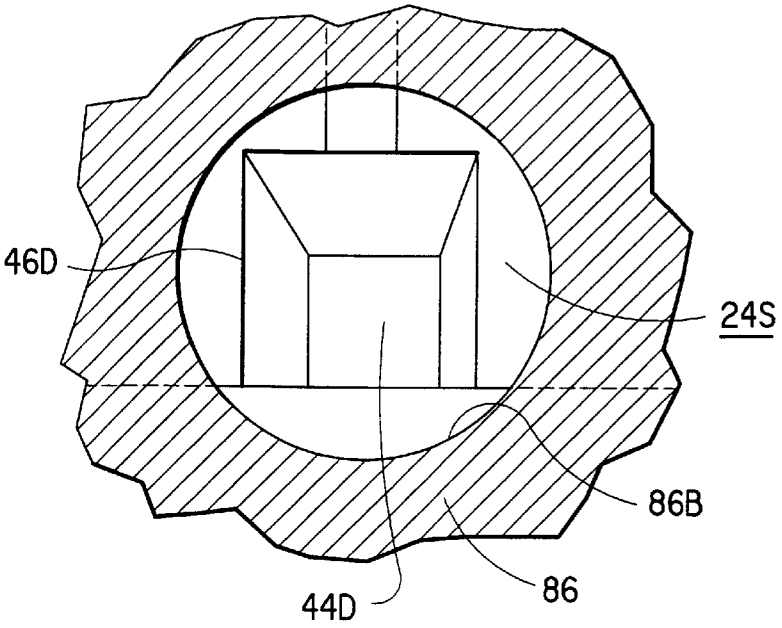
FIG. 6 is an enlarged, sectional view of a the transition between the jet portion and the stuffer tube portion of the yarn bulker taken along section lines 6—6 of FIG. 2A.

As seen in FIG. 6 shown is the transition between the cylindrical bore 86B of the stuffer chamber 86 and the downstream end 46D of the rectangular expanding section 46 of the yarn passage 40. As seen in the Figure the boundary of the bore 86B encompasses the periphery of the downstream end 46D of the rectangular expanding section 46, thus facilitating passage of yarn from the jet portion 14 to the stuffer tube portion 16. Also seen in FIG. 6 is the sealing surface 24S on the cover 24 and the downstream end 44D of the throat 44.

Figure 7B:
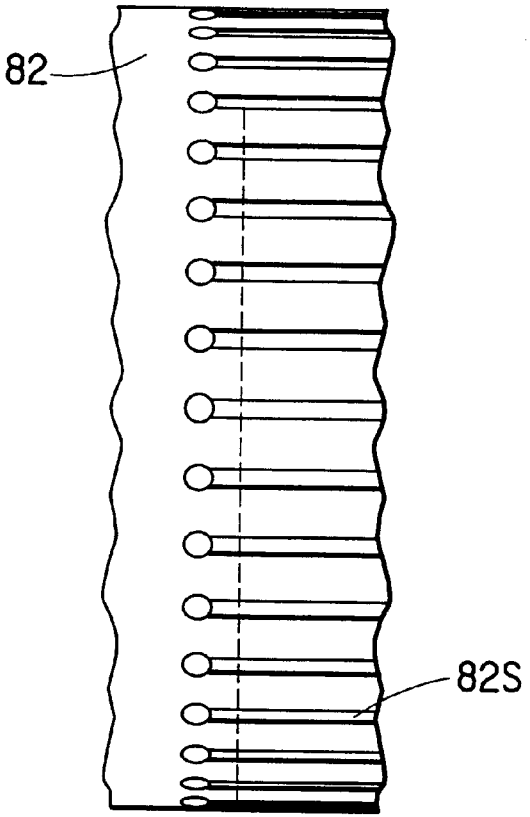
FIG. 7B is a side elevational view the stuffer chamber portion shown in FIG. 7A.
Figure 7A:
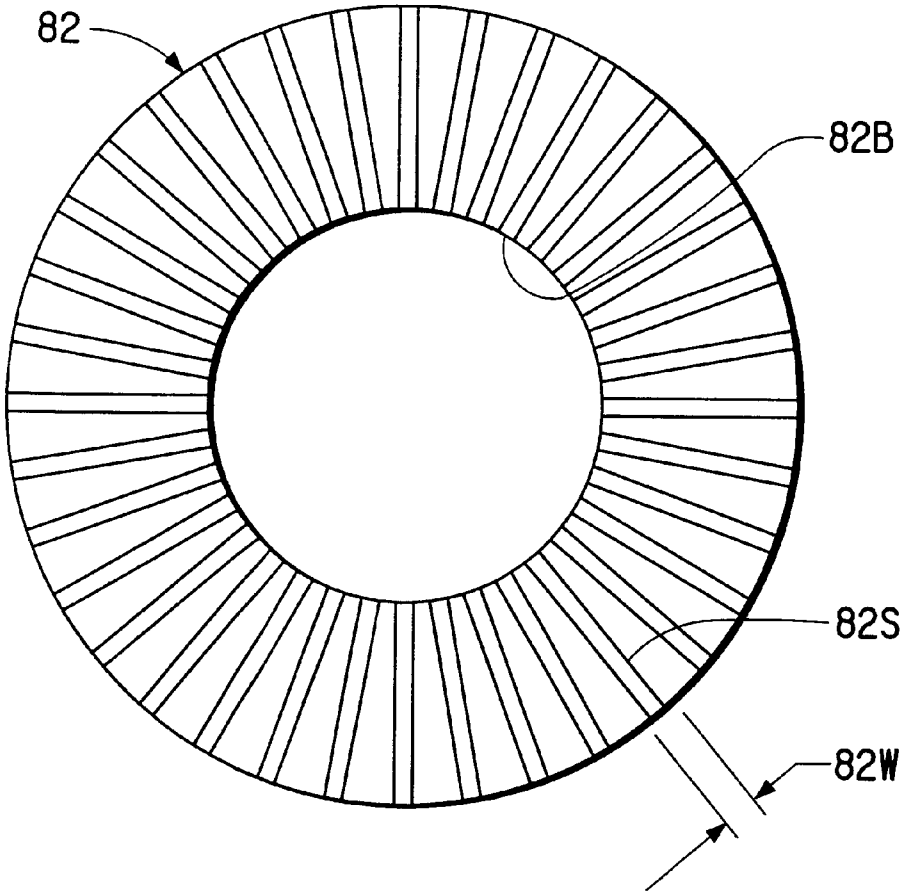

The central portion of the stuffer chamber section 82 has a plurality of narrow, elongated radial slots 82S (FIG. 2B) disposed about its circumference. The slots 82S (best seen in FIGS. 7A, 7B) extend completely through the wall of the stuffer chamber 82 so that the interior thereof may be vented. Each slot 82S has a circumferential width dimension 82W that is about ten to fifteen times larger than the diameter of a filament in the yarn passing through the slot to discourage passage of bent filaments through the slot. There should be a sufficient number of slots 82S around the circumference of the stuffer chamber 82 that the total flow area afforded by the slots is sufficient to pass the flow of fluid needed to compact the yarn in the stuffer chamber 82, as will be described. The bore 82B of the stuffer chamber 82 diverges over approximately the upstream half of the length of the slotted central portion of the stuffer chamber section 82. The divergence is the range from about two to about six degrees, and preferably about four degrees, in the direction of yarn flow F.

The yarn transport section is formed from a tubular member 86T having a central axial bore 86B extending therethrough. The axial bore 86B of the tubular member 86T communicates with the central bore 82B of the stuffer section 82. The first, upper, end 86E of the transport tube 86T is telescopically received into the lower end of the stuffer chamber section 82 and there held in place by a set screw 86S. The lower, second, end 86D of the transport tube 86T has formed therein a passage 86P that communicates with the bore 86B. The diameter of the passage 86P is slightly greater than (on the order of 0.01 to 0.02 inches) the diameter of the transport tube 86T (perpendicular to the axis 86A).

Figure 8B:
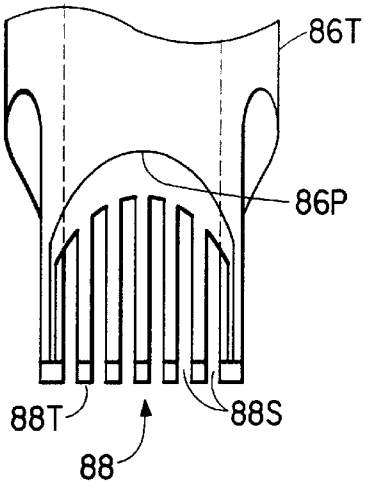
FIGS. 8B and 8C are elevational views taken along respective view lines 8B—8B, 8C—8C in FIG. 8A.
Figure 8C:
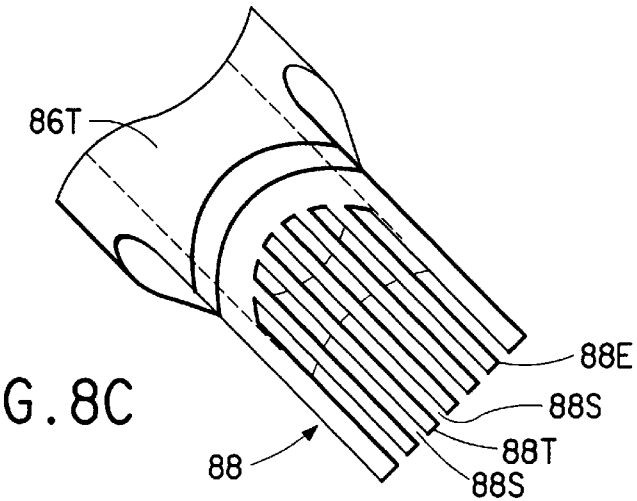
Figure 8A:
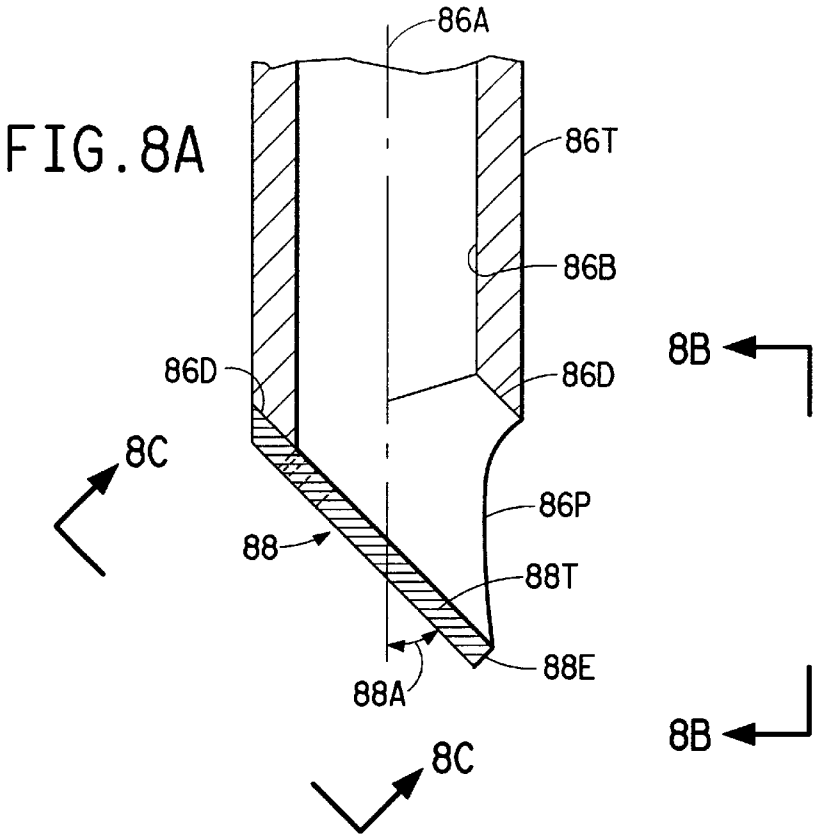

A slotted deflector plate 88 (best seen in FIGS. 8B and 8C) is attached to the second, lower, end of transport tube 86T. The deflector plate is inclined at a predetermined angle 88A to the axis 86A of the bore 86B of the tubular member 86T toward the passage 86P. The angle of inclination 86A is in the range from about thirty (30) to about (60) degrees. The deflector plate 88 is perforated by an array of open ended slots 88S that define a plurality of tines 88T. The ends 88E of the tines 88T lie within the passage 86P in the tubular member 86T and define a portion of the lower boundary thereof.

The slots 88S between tines 88T should be sized to pass fluid from the bore 86B of the tube 86T, but not to pass looped and coiled yarn that may otherwise hang-up on the plate 88. The perforations in the deflector plate 88 may take other forms, such as closed slots or holes, if desired, so long as such perforations are sized only to pass fluid therethrough.

Linkage Arrangement

The base 20 and the cover 24 are connected together for movement from an open to a closed position by the links 26 and are held in the closed position by the locking bolt 30. As is seen from FIGS. 9A through 9D, the links 26 are attached to the base 20 and the cover 24 on the side of the body 18 opposite to the side illustrated in FIG. 2A. When the cover 24 is in the open position, it is noted that the mating surface 24M on the cover 24 lies vertically above all portions of the base.

Both the base 20 and the cover 24 have generally triangular shaped recesses 92A, 92B that form pockets to accept the links 26. Each link 26 as seen in isolation in FIG. 9D, has relatively enlarged endpiece sections 26E that are joined by a generally linear bar section 26B. The transition region between each endpiece section 26E and the bar 26B define thin, elastically deformable regions 26R. One endpiece section 26E of each link 26 is pivotally mounted to the base 20 and to the cover 24 through pivot pins 26P. Each pivot pin has an enlarged head on one end and a recess on the opposite end. A clip 26C holds the pivot pin 26P in place on the cover 24 or base 20, as the case may be.

Figure 9A:
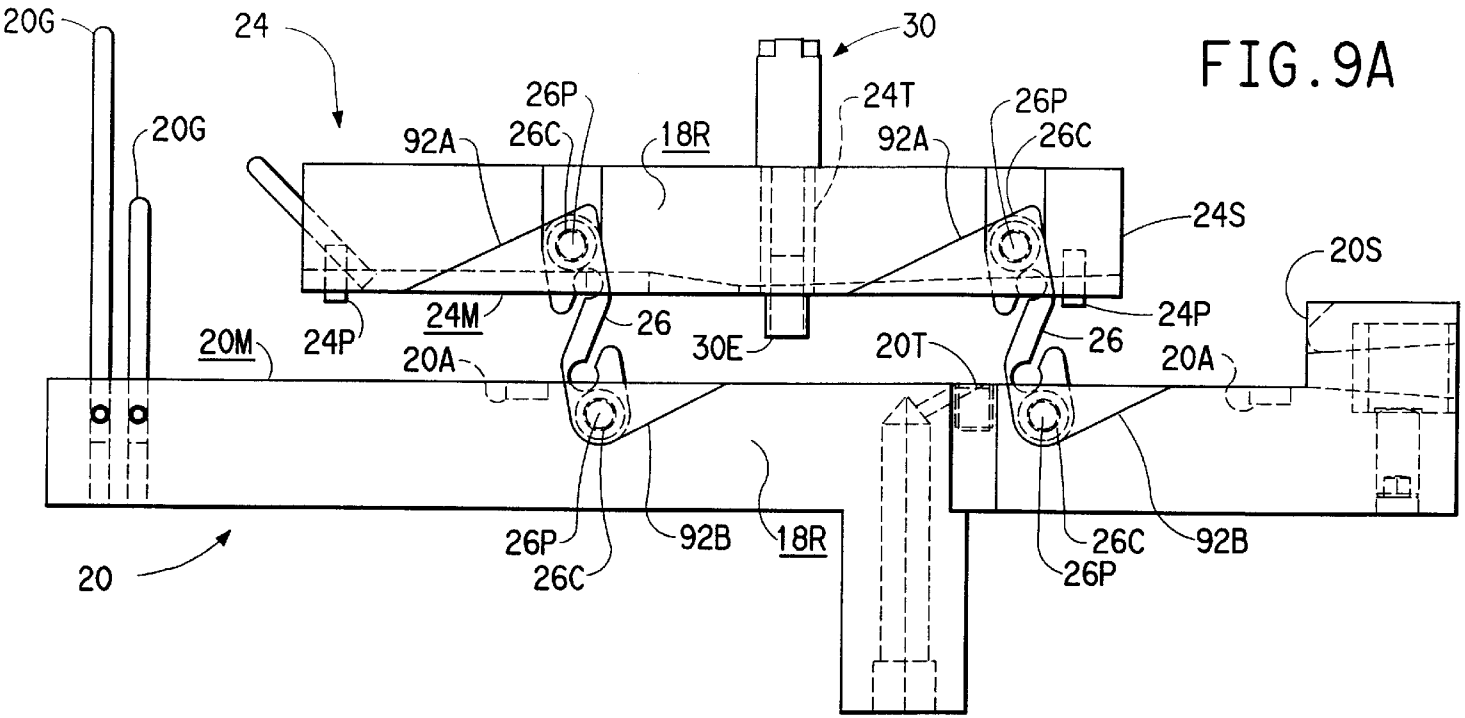

FIG. 9A shows the base 20 and the cover 24 in the fully open position. When in the fully open position the threaded end 30E of the locking bolt 30, as well as the end of each of the aligning pins 24P disposed in the cover 24 are visible. The fully open position is defined where the links 26 stop against one side of the recesses 92A, 92B. In this position, any fluid still passing from the channel 20C is freely vented past the sealing surfaces 20S, 24S.

To join the cover 24 to the base 20, the cover 24 rotates on the pivot pins 26P of the links 26 in a generally clockwise direction relative to the base 20 (as viewed in FIG. 9A).

Figure 9D:
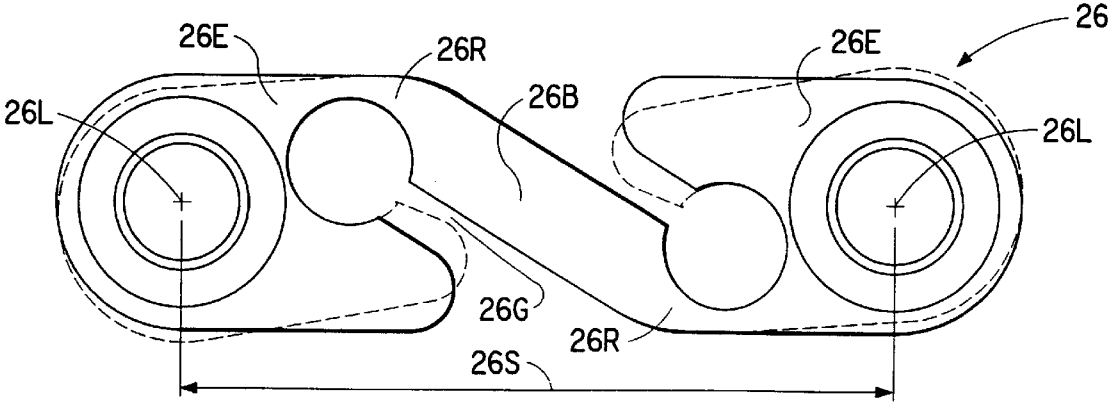
FIG. 9D is an isolated elevational view of one of the linkages connecting the base to the cover.
Figure 9B:
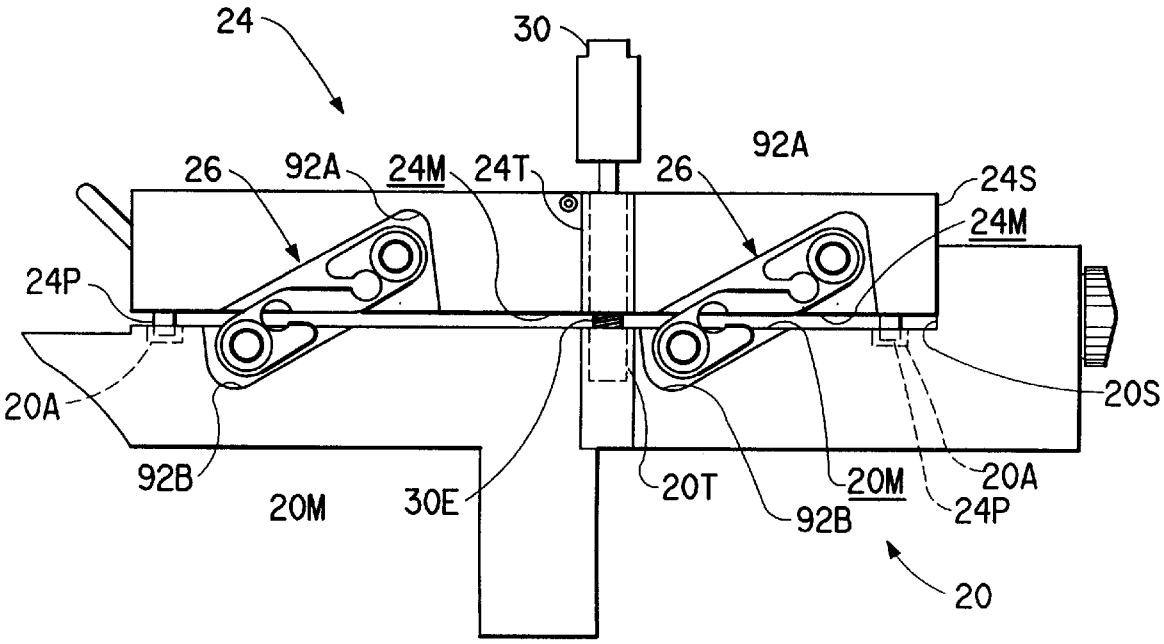

As is seen in FIG. 9B the clockwise pivotal motion on the pins 26P brings the sealing surface 24S on the cover 24 into abutting contact with the sealing surface 20S on the base 20. In the intermediate, partially closed position shown in FIG. 9B the end 30E of the bolt 30 is received in the mounting opening 20T in the base 20 while the end of the aligning pins 24P is received in the corresponding aligning slot 20A. The locking bolt 30 may have to be partially retracted into the opening 24T to permit the end 30E to align with the opening 20T.

Figure 9C:
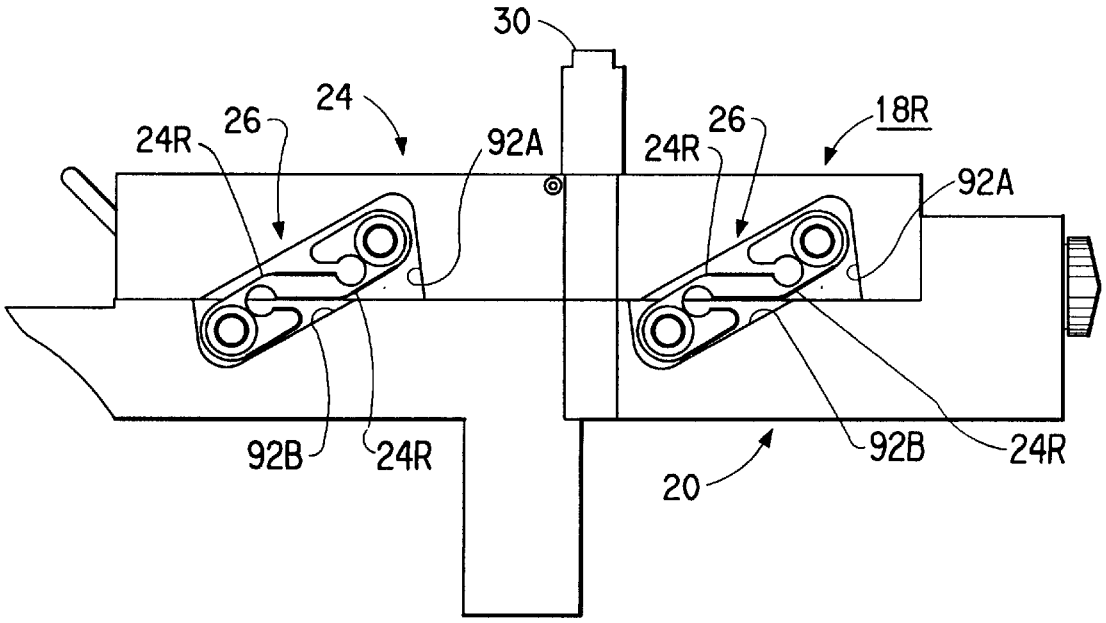

The end 30E of the bolt 30 is threaded into the opening 20T of draw the mating surfaces 20M, 24M on the cover and base, respectively, into intimate abutting contact (FIG. 9C). As the bolt 30 draws the base 20 and cover 24 together the links 26 deform in the deformable regions 26R to exert a force on the cover 24 to press it tightly to the base 20 along the respective sealing surfaces 20S, 24S while simultaneously joining these members along their mating surfaces 20M, 24M. The link 26 in its deformed condition is illustrated in dashed lines in FIG. 9D. As seen in FIG. 9D, when deformed, the gap 26G between the endpieces 26E and the bar 26B narrows and the spacing 26S between the centerlines 26L of the pivot pin openings is shortened.

Operation

Figure 10:
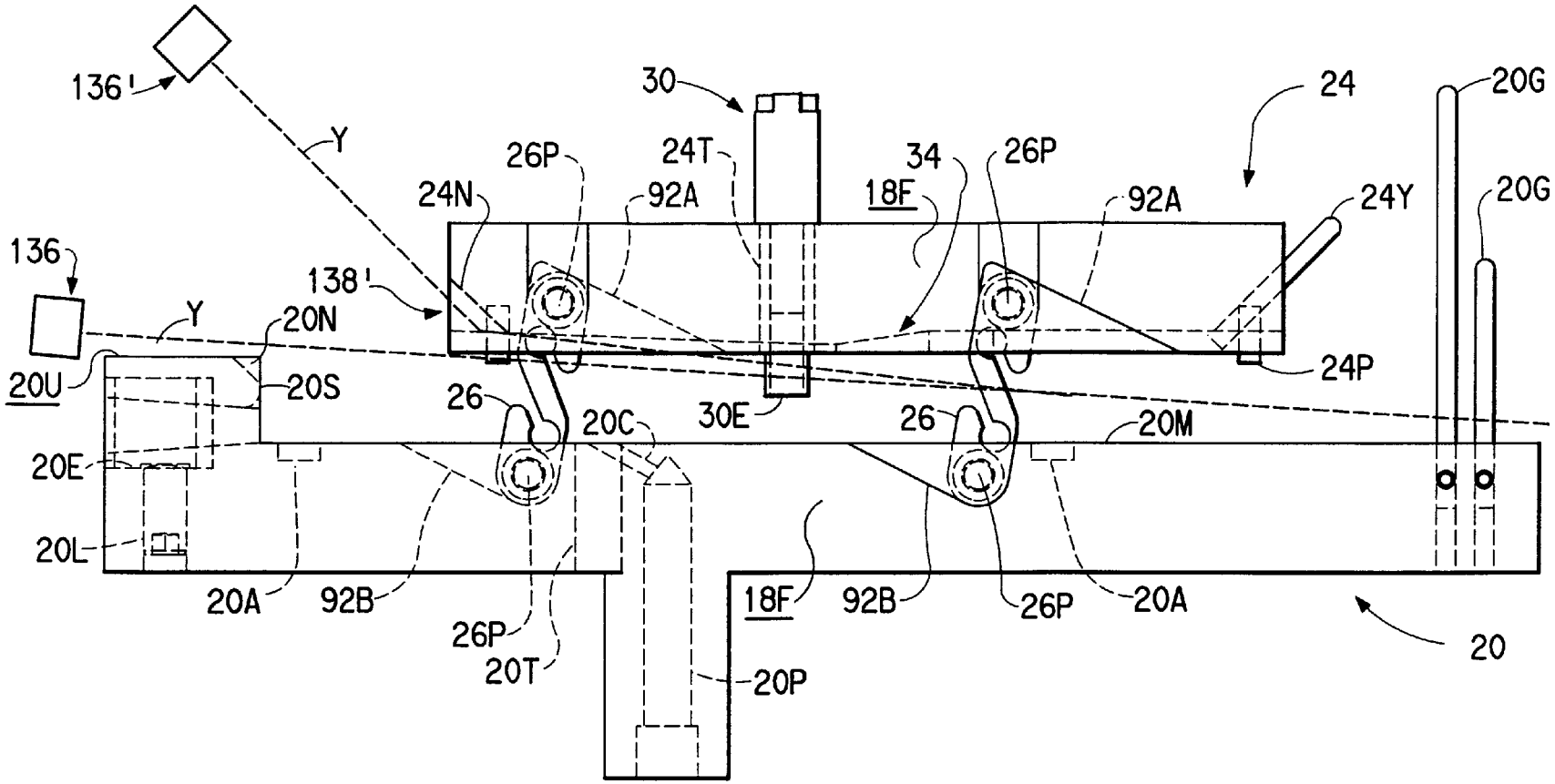
FIG. 10 is a view of the jet portion of the yarn bulker with the cover and the base in the open position, whereby the threading of the bulker may be understood.

As best seen in FIG. 10, with the cover portion 24 in the open position the yarn Y is threaded therethrough. Since the links 26 are only on the far side of the body 18 (FIG. 9A), the near surface 18F (FIGS. 2, 10) is open to receive a continuous filament yarn Y. The individual yarn Y is guided, for instance, with a sucker waste gun 136 that vacuums the yarn line while the line continues to run. The pin guide 24Y on the cover 24 and the pair of guides 20G on the base 20 aid in threading of the yarn. These members guide the yarn Y into alignment with the groove 34 in the cover 24 as the yarn is being threaded. Since, as noted, when opened the mating surface 24M of the cover 24 is slightly above the surface 20U (FIG. 2A) of the base 20, threading of the yarn is facilitated, particularly if adjacent yarn bulkers are present. After aligning the yarn with groove 34, the operator raises the sucker gun 136 (to the position as shown at 136') so the yarn passes (as shown at 138') through the shallow threading notch 24N at the end of cover 24. During this time if still flowing fluid from the channel 20C vents between the sealing surfaces 20S, 24S.

The cover 24 and the base 20 are closed, as described in connection with FIGS. 9A through 9D. When closed, the yarn extends through the enclosed yarn passage 40 so defined. In addition, when closed, the threading notch 20N in the base 20 and the corresponding notch 24N in the cover 24 cooperate to define an exit aperture for the yarn being threaded. If the body 18 is fabricated in one piece, the jet portion 14 is threaded using a lanyard to carry the cut end of the yarn into the yarn passage.

At this point the operator is prepared to thread the yarn Y through the stuffer tube portion 16 of the yarn bulker 10. This is accomplished by activating pressure source P to cause pressurized fluid to flow through pressurized fluid conduit 20D into the bulking passage 40. The yarn line Y is then cut and released from the waste gun. The cut end is drawn through threading aperture into the stuffer chamber 82 and transport tube 86 of the stuffer tube portion 16.

The slotted deflector plate 88 at the end of the transport tube 86T slows the passage of yarn so a wad W, consisting of loops and coils of yarn Y, can be started in the transport tube 86T. Most of the fluid passes through the slots 88S in the deflector plate 88. The wad W continues to grow along the length of the tube 86T until the wad W enters the vented stuffer chamber section 82 and partially covers the vent slots 82S. As the wad W continues to fill the stuffer chamber section 82 a greater portion of the slots are covered, further restricting venting of the fluid.

The wad W fills the vented section of the stuffer chamber 82 until an equilibrium is reached when the fluid pressure on the wad W increases to the point that the wad W is forced along the tube 86T at the same rate that the wad W is growing in length due to deposited yarn in the vented section of the stuffer chamber 82.

The diverging section of the stuffer chamber 82 is important in controlling the balance between the friction forces and fluid forces. The angle of divergence may be changed for different friction characteristics in different yarn products or for different operating conditions of fluid (pressure, temperature, flow).

The moving wad exits tube 86T through the opening 86P and is directed onto the roll R, as seen in FIG. 1.

It is believed that the yarn bulker 10 provides higher inlet tensions in yarn Y and results in a bulkier yarn than is possible with prior art yarn bulkers. Higher inlet tensions aids in removing yarn from the hot rolls D (FIG. 1), thereby minimizing occurrences of roll wraps. It is also believed that the yarn bulker 10 produces little or no interlace and entanglement in yarn Y so a controlled amount of interlace can be separately applied later. This is very useful if it is desired to add a filament, such as an anti-static or other special purpose filament, to yarn Y after bulking. It is further believed that the yarn bulker produces a high level of bulk using less pressurized fluid through conduit 20D than equivalent prior art devices.

The ability to produce higher bulk also offers the possibility of producing the same bulk level as prior art devices while using a lower temperature for the pressurized fluid. In the case of bulking carpet yarn, the lower temperature fluid translates into better tip definition when the yarn is ply-twisted and heat set for use in a cut pile carpet. The modular design comprising separable parts for the body and cover of the bulking jet housing, and the fluid venting section and wad forwarding section of the wad forming tube, makes the yarn bulker 10 easy to fabricate and maintain. The parts can be made with a high level of repeatability so bulker performance in highly repeatable. The replaceable restricted section of the groove, where wear from abrasive yarn is highest, makes maintainance easy and allows use of the bulker with a wide variety of yarns. The removeable cover of the bulking jet housing makes the bulker easy to thread, and the flexible links ensure the cover is tightly sealed to the body during operation of the housing.

Those skilled in the art, having the benefit of the teachings of the present invention as hereinabove set forth, may effect numerous modifications thereto. Such modifications are to be construed as lying within the contemplation of the present invention, as defined by the appended claims.

What is claimed is:

1. A non-interlacing expirating yarn bulker comprising:

a body having an enclosed yarn passage extending therethrough, the yarn passage including an inlet region, a throat region and an expanding region, the inlet region joining the throat region at the upstream end of the throat and the expanding region joining the throat region at the downstream end of the throat, the area of the inlet region at its downstream end being indicated by $A_i$, a single pressurized fluid channel extending through the body and intersecting with the yarn passage in the throat region, the throat region, at its downstream end, having a substantially rectangular cross-sectional configuration taken in a first cross-sectional plane perpendicular to a first yarn flow vector defined at the downstream end of the throat region, the area of the throat region at its downstream end being indicated by $A_t$, the area of the inlet region $A_i$ being less than the area $A_t$, the pressurized fluid channel in the vicinity of its intersection with the throat region having a rectangular cross-sectional configuration taken in a second cross-sectional plane perpendicular to a fluid flow vector extending therethrough, the area of the pressurized fluid flow channel in the vicinity of its intersection with the throat region being indicated by $A_p$, the expanding region having an exit end spaced a predetermined distance L from the throat, the distance L being in the range from about one (1) inch to about twelve (12) inches, the end of the expanding region having a rectangular cross-sectional area taken in a third cross-sectional plane perpendicular to a second yarn flow vector defined at the downstream end of the expanding region, the area of the expanding region at its end being indicated by $A_e$, the throat and the pressurized fluid channel, along their intersection, having equal width dimensions, as taken in any cross-sectional plane perpendicular to an axis aligned with the first yarn flow vector and extending through the throat, and the ratio of the area $A_t$ to the area $A_p$ being in the range from about 0.5 to about 2.0, the ratio of the area $A_e$ to the area $A_t$ being in the range from about 1.1 to about 3.0.

2. The non-interlacing expirating yarn bulker of claim 1 wherein the inlet region and the pressurized fluid channel are both symmetrical about a common reference plane of symmetry.

3. The non-interlacing expirating yarn bulker of claim 1 wherein the body comprises a first and a second structural member each of which has a mating surface thereon, the members being joinable along their mating surfaces, the members, when joined, defining the enclosed yarn passage, the single pressure channel being completely formed in the first structural member.

4. The non-interlacing expirating yarn bulker of claim 3 wherein the first structural member has a planar surface thereon, and the second structural member has a groove formed therein, when mated, the planar surface on the first structural member and the groove in the second structural member cooperate to define the yarn passage.

5. The non-interlacing expirating yarn bulker of claim 3 wherein each of the mating surfaces is a planar surface, and wherein each of the first and second members has a planar sealing surface distinct from the mating surface thereon, the plane of the sealing surface on each member intersecting with the plane of the mating surface on that member.

6. The non-interlacing expirating yarn bulker of claim 1 further comprising:

a member insertable into the body, the insert having an upstream face, a downstream face, and a channel extending therebetween, the intersection of the channel and the downstream face of the member defining a wear edge, when inserted into the body, the channel defining at least a portion of the inlet region of the yarn passage, and the downstream face of the member defining the upstream boundary of the throat.

7. The non-interlacing expirating yarn bulker of claim 3 further comprising:

the second member having an opening therein, a member insertable into the opening in the second member into abutting relationship with the mating surface of the first member, the insert having an upstream face, a downstream face, and a channel extending therebetween, the intersection of the channel and the downstream face of the member defining a wear edge, when inserted into the body, the channel defining at least a portion of the inlet region of the yarn passage, and the downstream face of the member defining the upstream boundary of the throat; and a resilient member for biasing the insert into abutting relationship with the mating surface of the first member.

8. In a fluid bulker for treating a yarn, the bulker including a body having a throat defined therein, the body having an abutment surface thereon, the improvement comprising:

a member insertable into the body into abutting relationship with the abutment surface, the insert having an upstream face, a downstream face, and a channel extending therebetween, the intersection of the channel and the downstream face of the member defining a wear edge, when inserted into the body, the channel defining at least a portion of a yarn passage extending through the body and the downstream face of the member defining the upstream boundary of the throat; and a resilient member for biasing the insert into abutting relationship with the abutment surface.

9. The fluid bulker of claim 8, wherein the body is fabricated of a material having a first hardness value and the insert is fabricated of a material having a second hardness value, the second hardness value being greater than the first hardness value.

10. In a bulker for treating a yarn, the bulker including:

a body having a yarn passage therein, a stuffer chamber section communicating with the yarn passage for forming a wad of yarn, and, a yarn transport section, the yarn transport section being formed by a tubular member having an axial bore extending therethrough, the tubular member having a first and a second end, the first end of the tubular member communicating with the stuffer chamber, the improvement comprising:

the tubular member having a passage communicating with the axial bore formed adjacent to the second end thereof, and a deflector plate attached to the tubular member adjacent to the second end thereof, the deflector plate being inclined to the axis of the bore and toward the passage in the tubular wall member, the deflector plate having perforations therein.

11. The bulker of claim 10 wherein the deflector plate is inclined at an angle of inclination in the range from about thirty (30) to about sixty (60) degrees.

12. The bulker of claim 10 wherein the deflector plate is perforated by a plurality of slots that define a plurality of tines, each tine having an end thereon, the ends of the tines being within the passage and defining a portion of the boundary thereof.

* * * * *